United States Patent [19]

Collins

[11] 4,171,058

[45] Oct. 16, 1979

[54] KNOCK-DOWN SLOT-LOCK CONTAINER

[75] Inventor: Edward H. Collins, Medford, Oreg.

[73] Assignee: The Mt. Pitt Company, Medford, Oreg.

[21] Appl. No.: 866,505

[22] Filed: Jan. 3, 1978

[51] Int. Cl.[2] ..... B65D 9/12; B65D 9/34; B65D 7/24

[52] U.S. Cl. ..... 217/12 R; 217/13; 217/43 A; 217/65; 220/4 F

[58] Field of Search ..... 217/12 R, 13, 31, 43 A, 217/65, 43 R, 56; 220/4 F

[56] References Cited

U.S. PATENT DOCUMENTS

| | | | |
|---|---|---|---|
| 593,180 | 11/1897 | Naramor | 217/43 |
| 919,768 | 4/1909 | Reber | 217/56 |
| 1,003,686 | 9/1911 | Anderson | 217/56 |

*Primary Examiner*—George E. Lowrance

*Attorney, Agent, or Firm*—Kolisch, Hartwell, Dickinson & Stuart

[57] ABSTRACT

A knock-down container comprising four interlocked side panels and a panel-supporting pallet. Each side panel has opposing end regions which extend beyond the outwardly-facing surfaces of adjacent interlocked panels. Cleats attached to the inwardly-facing surfaces of each end region abut the outwardly-facing surfaces of adjacent panels to brace adjacent panels against an outwardly-directed force. The interlocked panels are supported on pallet skids which extend outwardly from two opposite edges of a pallet base.

1 Claim, 6 Drawing Figures

KNOCK-DOWN SLOT-LOCK CONTAINER

BACKGROUND AND SUMMARY

The present invention relates to containers, and in particular to knock-down containers which can be assembled from interlocking panels.

Knock-down containers which can be easily assembled from interlocking panels are useful in the shipping and storing of goods. In situations in which the shipping container is intended to be returned to the shipper, it is particularly desirable to be able to disassemble the shipping box into a compact form for its return. Further, in the storing of goods, inventory fluctuations may make it desirable to employ storage boxes which can be disassembled and stored in a minimum space.

Ideally, knock-down containers of this type should incorporate the following features:

The side panels and bottom member of the container should be lightweight, yet the construction of the assembled container be such that the container can withstand considerable outwardly-directed force from the weight of the contained goods. This feature permits relatively heavy loads to be shipped in relatively lightweight and inexpensive containers.

The container construction should also permit vertical stacking of mulltiple containers, preferably by a fork lift.

The four sides of the container should be supported by, but not interlocked with, the bottom member. This feature facilitates assembly and disassembly of the box. Specifically, the problem of one man attempting to simultaneously interlock two large side panels with a bottom member is avoided.

The box should also be assemblable and disassemblable without the use of special tools, or hardware, or strapping.

Finally, the disassembled container should form a compact and easily shipped item.

Accordingly, it is an object of the present invention to provide a knock-down container incorporating the above-described advantageous features.

More specifically, it is an object of the invention to provide a knock-down container having lightweight panels having an interlock construction which serves to reinforce the sides of the assembled container against an outwardly-directed force.

It is a further object of the present invention to provide such a container in which the interlocked side walls are supported by a bottom pallet. This pallet and the supported panels are designed to be lifted by a conventional forklift truck or the like.

It is yet another object of the present invention to provide a knock-down container which is compact in its disassembled form.

The present invention comprises four interlocking side panels and a pallet designed to support the interlocked panels. The interlocked side panels form a four-sided enclosure in which the side end regions of each panel extend beyond the outwardly-facing surfaces of adjacent side panels. Elongate strips or cleats attached to the inwardly-facing surfaces of the side end regions abut the outwardly-facing surfaces of adjacent interlocked panels to brace the adjacent panels against an outwardly-directed force. The pallet provides a base supported on a plurality of skids which extend outwardly from two opposite edges of the base. In the assembled container, the lower edges of two opposite side panels are supported by the skids, the two panels so supported being dimensioned so that the upper edges of the assembled container are substantially coplanar.

These and other objects and features of the present invention will now be described with reference to the following detailed description of a preferred embodiment of the invention and the accompanying drawings.

DETAILED DESCRIPTION OF A PREFERRED EMBODIMENT OF THE INVENTION

Figure 1:
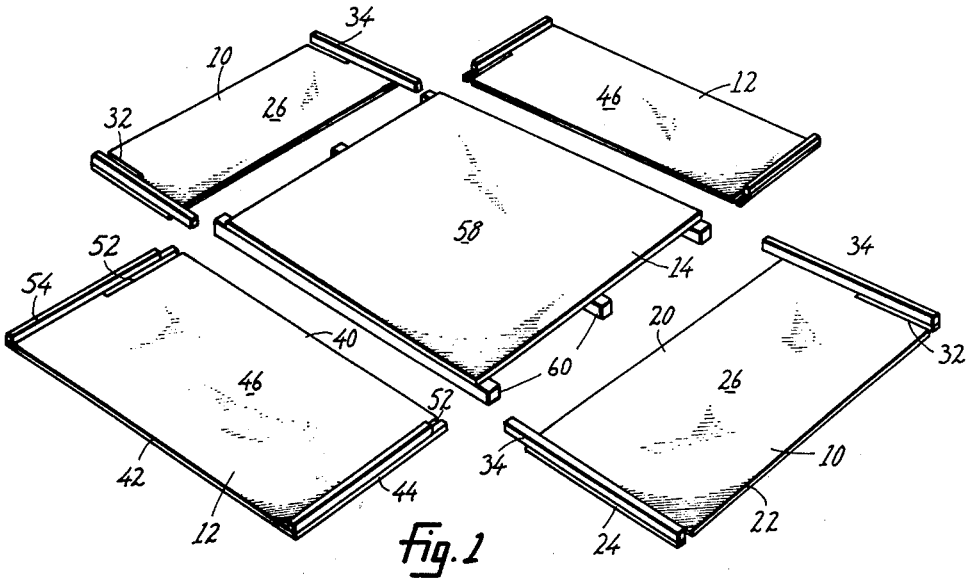
FIG. 1 is a perspective view of the disassembled knock-down container.
Figure 5:
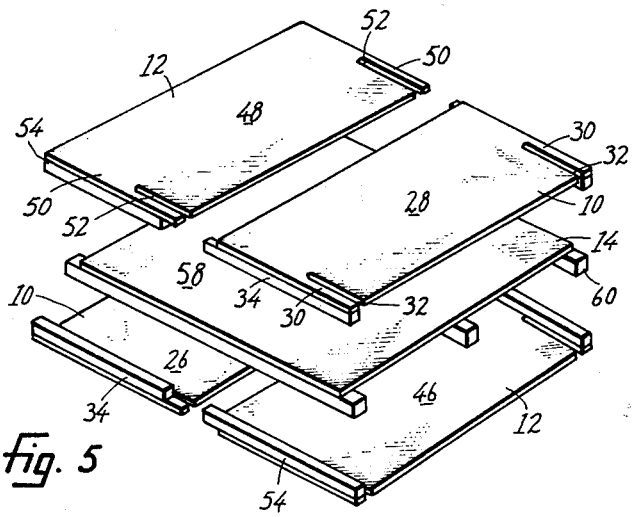
FIG. 5 shows in exploded view the stacking arrangement of the disassembled container.

Referring now to FIGS. 1 and 5, there is shown the disassembled container of the present invention, comprising a pair of opposite side panels 10, a pair of opposite side panels 12, and a bottom member 14. Side panels 10 each have a lower edge 20, an upper edge 22, and a pair of opposite side edges 24. The panel surfaces which are visible in FIG. 1 are the panel surfaces which are inwardly-facing in the assembled box and are herein defined as the front, or inwardly-facing surfaces 26. Similarly, the panel surfaces not visible in FIG. 1 are defined as the back, or outwardly-facing surfaces 28. The opposed regions adjacent each side edge 24 are defined as the side end regions 30 these regions bounding a central section therebetween. A pair of parallel slots 32 extend adjacent the upper portion of the side end regions, generally defining panel slot means. Rigidly attached to the inwardly-facing surfaces of the side end regions are side support means generally including a pair of cleats 34. In the preferred embodiment, the panels 10 are preferably thin plywood and the cleats are 34 wooden strips which are attached thereto by conventional means, for example, by glue or staples.

Similarly, each opposite side panel 12 has a lower edge 40, an upper edge 42 and a pair of side end regions 44 bounding a central section. Inwardly-facing side 46, outwardly-facing side 48 and side end regions 50 of each panel 12 are defined as for each panel 10. A pair of parallel slots 52 extend adjacent the lower portion of the side end regions, and a pair of cleats 54 are secured, as in panel 10, to the inwardly-facing surfaces of the side end regions.

Bottom member 14 is a pallet having a base 58 supported on a plurality of skids 60 projecting outwardly from two opposite edges of the base. Base 58 is attached to the skids by conventional means, e.g., nails and/or glue. Pallet 14 preferably has three skids arranged as shown in FIG. 1, the skids being so spaced as to allow insertion of the tines of a forklift truck therebetween for lifting and transporting the assembled container. Skids 60 provide means for mounting interlocked panels 10,12 on member 14, in a manner to be described.

Figure 2:
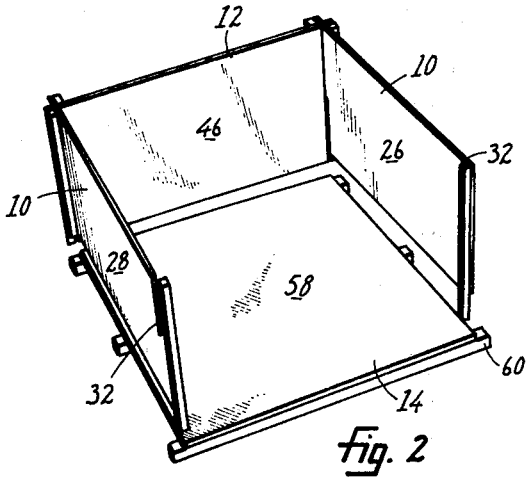
FIG. 2 is a perspective view of the partially assembled knock-down container.

The box may be assembed in the manner illustrated in FIG. 2. One of the panels 12 and opposing panels 10 are assembled by aligning opposing slots 52 of panel 10 with the associated slots 32 of panels 10 and vertically interlocking the four end slots. The resultant three-sided structure is then placed on the pallet with the panels 10 vertically adjacent the pallet skids. In assembled form, panel 10 lower edges 20 are supported on the upper surfaces of skids 60, with the cleats 34 of panels 10 extending below the edges 20 a distance equal to the height of the skids, whereby the cleats 34 rest on the surface supporting the pallet. The lower side region of panel 12 abuts the associated side of the bottom pallet with its lower edge 40 flush with the bottom of the skids.

It can be appreciated from FIG. 2 that the resultant partially assembled container having a bottom and three sides is well suited for packing goods therein, having convenient side access. The container assembly is completed by aligning the slots 32 on panels 10 with the two slots on the second panel 12, and sliding panel 12 downwardly to an interlocked position symmetrical with the first-assembled panel 12. The container is assembled or disassembled without tools, hardware, or strapping. This simplifies container assembly and disassembly and also mimimizes shipping or storage costs associated with the container.

Figure 3:
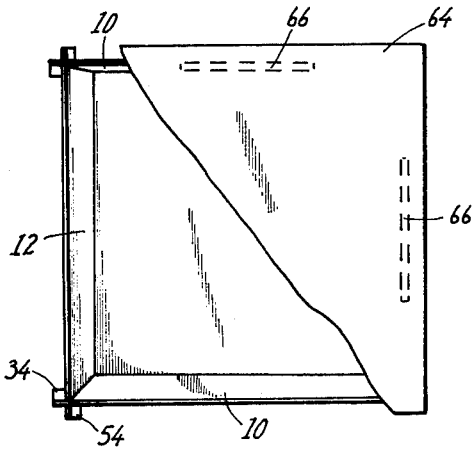
FIG. 3 is a plan view of the assembled knock-down container, showing a fragmentary portion of a container lid.
Figure 4:
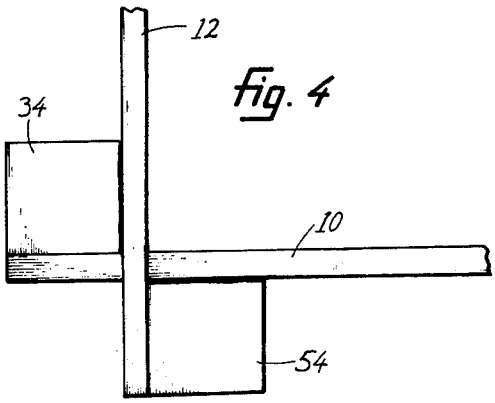
FIG. 4 is an enlarged view of a corner region of the assembled knock-down container shown in FIG. 3.

As seen in FIGS. 3 and 4, cleats 34 on panels 10 and cleats 54 on panels 12 abut the outwardly-facing surface of the adjacent interlocked panels in the assembled container. Explaining further, the outwardly-facing surface of each panel 10 is abutted on both sides by cleats 54 attached to the two panels 12 adjacent that panel 10. The other panel surfaces are similarly reinforced to brace these panels against an outwardly-directed force. This particular construction in which the side panels are braced by cleats attached to adjacent interlocked panels permits a relatively strong knock-down container to be constructed from relatively light-weight panel material, for example, thin plywood or reinforced carboard.

Figure 6:
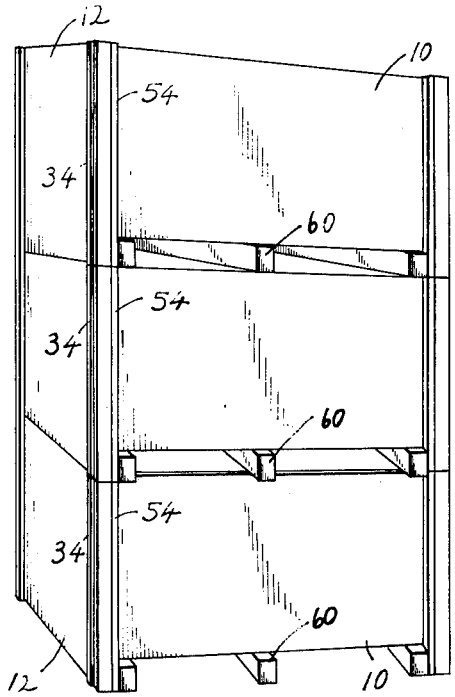
FIG. 6 is a perspective view of three vertically stacked knock-down containers.

Cleats 34 and 54 also provide vertical support when the containers are vertically stacked, as seen in FIG. 6. As seen in this figure, the height of each panel 10 is less than the height of each panel 12 by the vertical dimension of skids 60, so that, in the assembled container, the upper edges of the two panels are substantially coplanar. Similarly, cleats 34, 54 on panels 10, 12, respectively, are dimensioned to be substantially vertically coextensive with the adjacent interlocked panels, so that, in the assembled container, the bases of cleats 34 extend downwardly to the lower edges of panels 12. Thus, as indicated above, cleats 34 extend from the base of the container to the upper edge, forming a support column at each corner of the container. By this construction, heavily loaded containers may be stacked one on top of the other. The spaces between skids 60 of each container permit that container to be placed on or removed from the stack by a conventional fork lift.

It will be appreciated that when the container is carried from below in the access region between skids 60, the integrity of the container is maintained by the support provided by the skids 60 against lower edges 20 of panels 10. If it is desired securely to attach the sides of the box container to the pallet, this may be easily done by driving a nail, or peg or the like through the lower portion of panels 12 into the adjacent skids 60.

There is also shown fragmentarily in FIG. 4 a lid 64 which may optionally be used in conjunction with the above-described knock-down container. Lid 64 has securely attached on its lower surface peripherally located cleats 66, which are designed to abut the inwardly-facing surface of the panels 10 and 12 when the lid is placed on the top of the disassembled container.

An additional feature of the above-described invention is the compact form in which it may be stored or shipped when disassembled. The preferred packing configuration of the disassembled box is shown in exploded view in FIG. 5. Here panels 10 and 12 are arranged, edge to edge, as shown, to form two edge-to-edge panel sets with the pallet sandwiched therebetween.

While a preferred embodiment of the invention has been described, it should be apparent to those skilled in the art that other variations and modifications are possible without departing from the spirit of the invention.

It is claimed and desired to secure by Letters Patent:

1. A knock-down container comprising first and second pairs of panels, each panel having front and back surfaces, upper and lower edges, and a central section bounded by opposed side end regions, slot means adjacent said panel end regions for interlocking panels of said first pair with panels of said second pair to form an interlocked, noncollapsible structure in which said front surface of each panel faces inwardly, and said opposed, side end regions of each panel extend beyond said back surfaces of panels interlocked therewith, with said upper edges of said panels forming said structure being substantially coplanar, said slot means comprising, for each panel of said first pair of panels, a pair of vertical slots which extend adjacent an upper portion of said side end regions, and open to said upper edge, and, for each panel of said second pair of panels, a pair of vertical slots which extend adjacent a lower portion of said side end regions, and open to said lower edge, cleats attached to said front surfaces of said side end regions of each panel, positioned thereon to abut the back surfaces of opposed panels interlocked therewith to brace said opposed panels against a force directed against the front surface thereof, said cleats on said first pair of panels being substantially vertically coextensive with outwardly facing surfaces of adjacent interlocked panels of said second pair, a bottom member, and mounting means for mounting said structure on said bottom member, said mounting means including a plurality of skids extending outwardly from two opposite sides of said bottom member, said skids being dimensioned to support the lower edges of one of said pairs of panels with the lower edges of the other pair of panels and the cleats of the one pair of panels extending downwardly to the base of said skids.

* * * * *